United States Patent [19]

Kanatsu et al.

[11] Patent Number: 4,473,601

[45] Date of Patent: Sep. 25, 1984

[54] METHOD FOR PRODUCING VARIEGATED COATS

[75] Inventors: Koichi Kanatsu, Hirakata; Tateshi Yamazaki, Amagasaki, both of Japan

[73] Assignee: Nippon Paint Co., Ltd., Osaka, Japan

[21] Appl. No.: 497,298

[22] Filed: May 23, 1983

[30] Foreign Application Priority Data

May 28, 1982 [JP] Japan ..... 57-91853

[51] Int. Cl.[3] ..... B05D 3/00

[52] U.S. Cl. ..... 427/274; 427/277; 427/280

[58] Field of Search ..... 427/257, 262, 274, 277, 427/280, 264, 272, 267

[56] References Cited

U.S. PATENT DOCUMENTS 3,600,346 8/1971 Spatola ..... 427/274 X

*Primary Examiner*—Michael R. Lusignan
*Assistant Examiner*—K. E. Jaconetty
*Attorney, Agent, or Firm*—Millen & White

[57] ABSTRACT

A variegated coat is produced by the steps of preparing a synthetic emulsion coating composition containing a body pigment and a color pigment in a combined concentration higher than critical pigment volume concentration as well as a high boiling organic solvent or plasticizer, applying said coating composition on a surface, and polishing locally the resulting film after drying but while at least a portion of said solvent or plasticizer is still present in the surface layer of the coat.

11 Claims, No Drawings

METHOD FOR PRODUCING VARIEGATED COATS

BACKGROUND OF THE INVENTION

This invention relates to a method of producing a variegated coat.

A conventional method for the production of a variegated coat includes the steps of dispersing or liquid particles having a different color from a dispersion medium in said dispersion, and applying the resultant dispersion on a substrate surface. In another method, a patterned coating film is discontinuously produced on a background of a continuous base coat colored a different color from that of said coating film.

This invention provides a novel method for the production of a variegated coat, which is completely different from any of the hithereto-known methods.

DESCRIPTION OF THE INVENTION

We have found that a variegated coat can be produced by coating a surface with a synthetic resin emulsion coating containing a body pigment (extender) and a color pigment, in concentrations higher than the critical pigment volume concentration, and a high boiling organic solvent or a plasticizer and then polishing locally the resulting coat after drying but while at least a portion of said solvent or plasticizer is still present in the coat to produce a color difference between areas so polished and areas not polished, thereby giving a variegated coat.

The coating to be employed in the practice of the method is a synthetic resin emulsion coating composition containing a body pigment and a color pigment in a combined concentration higher than critical pigment volume concentration and a high boiling organic solvent or plasticizer. This invention is predicated on the principle that the desired gradation of color is produced not by using two coatings of different colors but by way of different surface finishes (polishing of selected areas) given to a coat obtained from a single coating material.

The above-mentioned coating composition is based on a synthetic resin emulsion (inclusive of hydrosols). Any of the conventional synthetic resin emulsions commonly employed in the art can be successfully employed. Thus, for example, polymer emulsions or synthetic latices prepared from one or more of such monomers as vinyl acetate, vinyl propionate, acrylic esters, methacrylic esters, vinyl versatate, maleic esters, fumaric esters, vinyl stearate, ethylene, butadiene, chloroprene, acrylonitrile, styrene, vinyl chloride, vinylidene chloride, $\alpha,\beta$-unsaturated carboxylic acids, etc., and aqueous dispersions of alkyd resins, epoxy resin, acrylic resins, etc. can be employed.

The pigments may be any of conventional pigment commonly employed in the art. As examples of said color pigment, there may be mentioned such inorganic pigments as titanium dioxide, lithopone, carbon black, lamp black, cadmium red, red iron oxide, molybdenum red, ferric oxide, cadmium yellow, yellow lead, titanium yellow, chromium oxide green, ultramarine, purrusian blue, etc. and such organic pigments as azo pigments, nitro pigments, lake pigments, phthalocyanine pigments, etc. The body pigment (extender) is exemplified by calcium carbonate, clay, talc, diatomaceous earth, magnesium carbonate, precipitated barium carbonate, silica powder, aluminum silicate, etc. The average particle size of such pigments is preferably not more than 4 microns (as calculated from the specific surface area thereof) and by using the pigments in this size range, there may be obtained a high gloss and a significant color contrast upon polishing.

In the practice of this invention, it is essential that the pigment volume concentration of the coating composition be higher than the critical pigment volume concentration. The term "critical pigment volume concentration" as used herein means the minimum pigment volume concentration that produces a pigment/air interface. When the pigment volume concentration of a coating material exceeds the critical pigment volume concentration, there occurs an area where the pigment cannot be covered with a binder so that a pigment/air interface is produced to cause a sharp increase in lightness. This phenomenon is due to the same mechanism (porosity effect) as the sharp increase in hiding power which is observed when the critical pigment volume concentration is exceeded in a white coating material containing a white pigment and a body pigment. Since the critical pigment volume concentration value varies with the oil absorption capacity of the pigment used and the binder power index of the binder used, the minimum pigment volume concentration actually required by the coating composition of this invention is not constant. Generally, however, a pigment volume concentration of at least 60% is desirable. The upper limit is generally 80%, although it is restricted by the workability of the coating composition, the required strength of the coat, etc.

The coating composition of this invention also contains a high boiling solvent or plasticizer. The term "plasticizer" as used herein means a substance which is added for external plasticization to impart flexibility to synthetic resins. Examples of plasticizers that can be used in accordance with this invention include ester type plasticizers such as dimethyl phthalate, diethyl phthalate, dibutyl phthalate, di-2-ethylhexyl phthalate, diisodecyl phthalate, tributyl phosphate, tricresyl phosphate, tri-2-ethylhexyl trimellitate, di-2-ethylhexyl adipate, butyl oleate, etc., epoxide type plasticizers such as epoxidized soybean oil, expoxidized linseed oil, butyl epoxystearate, etc., chlorinated paraffin, camphor, etc. The high boiling solvents that can be employed include polyhydric alcohols and their derivatives, such as ethylene glycol, diethylene glycol, diethylene glycol monoethyl ether and its acetate, diethylene glycol monobutyl ether and its acetate, diethylene glycol dibutyl ether, 2,2,4-trimethylpentane-1,3-diol monoisobutyrate, etc. and ester type solvents such as butyl benzoate, dioctyl adipate, etc. The addition of such a plasticizer or high-boiling solvent is to soften the coat and thereby improve the polishing result and this effect can be achieved unless at least a portion of the plasticizer or solvent so added still remains in the surface layer of the coat after drying and at the time of polishing. Therefore, a low boiling plasticizer or solvent is undesirable because it is lost from the surface of the coat before the coat is dried or in a short time after drying, leaving only a short time before the commencement of polishing. Therefore, the plasticizer or solvent should have a boiling point of at least 190° C./760 mmHg. The suitable level of addition is generally 1 to 20 weight parts to each 100 weight parts of the coating composition. In order to obtain a sufficient polishing effect, it is preferable that the polishing can be performed within the time period of 5 to 24 hours after drying.

By coating a surface with the above coating composition and polishing the dried coat locally within the above-mentioned time period, a variegated pattern can be produced on the surface. The polishing may be dry polishing, and may be performed manually with a cloth or with the aid of a portable polisher. In the case of a coat over a flat surface, it is convenient to use a pattern plate with cutouts corresponding to the desired pattern. Moreover, a still more attractive variegated pattern can be easily obtained by coating a substrate with the coating composition in a relief pattern by means of a spraying device or a roller, for instance, and polishing the projecting areas only. According to the kind of coating device, coating conditions, the kind and viscosity of coating composition, and the relief pattern formed, there can be obtained a variety of variegated patterns having various feelings such as a bronze-like feeling, one appearing as if a glaze were applied to the projections, a ceramic tile-like feeling, and so on.

In order to obtain a variegated pattern according to this new principle, it is essential that the pigment volume concentration of the coating material exceeds the critical pigment volume concentration so that the pigment is not completely covered with a binder and that there remains a portion of said plasticizer or high boiling solvent in the surface layer of the coat at the time of polishing so that the polishing effect is high. If the pigment volume concentration is below the critical pigment volume concentration, no satisfactory variegated effect can be obtained even if the plasticizer or solvent is still present. Conversely, as the pigment volume concentration is increased over the critical concentration, the percentage of areas of pigment particles not covered with the binder also increases so that if the coat is polished in the presence of the solvent or plasticizer, a gloss is produced to give a color difference between areas so polished and areas not polished and, hence, a variegated-color effect.

The areas so polished are reduced in surface roughness as compared with the unpolished areas and, therefore, the amount of random reflecting there decreases to give a hue having a relatively reduced lightness. Above the critical pigment volume concentration, as the pigment volume concentration of the coating composition is increased, the difference in lightness between the polished and the unpolished areas is increased to give a more prominent variegated pattern. Below the critical pigment volume concentration, the difference in lightness is not large enough to provide a variegated pattern.

This invention is not only suited to the interior and exterior finishing of buildings at site but also to the factory production of boards, decorated boards, etc. for prefabricated housing and other uses.

The following examples are further illustrative of the invention. It should be understood that in these examples all parts are by weight. The composition of coating bases used in the working and control examples are shown in Table 1.

The compositions of this invention were prepared by mixing these bases with a solvent or plasticizer, and where a two-can type binder was employed, further with a curing agent. To produce a variegated color finish, such a composition was further colored with a commercially available basic color emulsions or aqueous master color.

TABLE 1

| Ingredient | Coating base No. No. 1 (parts) | No. 2 (parts) | No. 3 (parts) | No. 4 (parts) |
|---|---|---|---|---|
| Titanium dioxide | — | — | 100 | — |
| Calcium carbonate whiting (Note 1) | 600 | 400 | 400 | 400 |
| Talc (Note 2) | — | 200 | 100 | 200 |
| Vinyl acetate-vinyl versatate copolymer emulsion (Note 3) | 145 | — | 145 | — |
| Styrene-acrylate copolymer emulsion (Note 4) | — | 145 | — | — |
| Epoxy resin emulsion (Note 5) | — | — | — | 13 |
| 25% Hydroxyethylcellulose, aq. solution (Note 6) | 120 | 120 | 120 | 20 |
| 25% Aqueous ammonia | 3 | 3 | 3 | [illegible] |
| Bestcide TB, preservative (Note 7) | 2 | 2 | 2 | 2 |
| Nopco NXZ, antifoaming agent (Note 8) | 5 | 5 | 5 | [illegible] |
| Demol ET, dispersant (Note 9) | 20 | 20 | 20 | 20 |
| Water | 105 | 105 | 105 | 105 |
| Total | 1000 | 1000 | 1000 | 938 |

Note 1: Takehara Kagaku Kogyo K.K., Sunlite 1000
Note 2: Maruo Calcium K.K., trade name Talc PKP-80
Note 3: Hoechst Gosei K.K., Movinyl DM21
Note 4: Hoechst Gosei K.K., Movinyl DM60
Note 5: Kanebo NSC K.K., Epolsion EA#2
Note 6: Hercules Co., Natrosol 250 MR
Note 7: Dainippon Ink and Chemicals Inc.
Note 8: San Nopco Ltd.
Note 9: Kao Soap Co.

105 parts of water, 20 parts of Demol ET, 2 parts of Bestcide TB, 5 parts of Nopco NXZ, 3 parts of 25% aqueous ammonia and 120 parts of 2.5% aq. solution of hydroxyethylcellulose are thoroughly mixed. This mixture is further stirred with 145 parts of Movinyl DM 21. Then, 600 parts of Sunlite 1000 are added and dispersed well to provide Coating Base No. 1. The dispersing is carried out by means of a disperser or a twin mixer. Coating Bases No. 2, No. 3 and No. 4 are also prepared in the same manner.

EXAMPLE 1

| | |
|---|---|
| Coating Base No. 1 | 940 |
| Ethylene glycol | 20 |
| Dibutyl phthalate | 20 |
| Texanol (Note 10) | 20 |
| Hi-Vinylex Yellow Brown (Note 11) | 23 |
| Hi-Vinylex Red Rust (Note 12) | 4 |
| Hi-Vinylex Black (Note 13) | 3 |
| Total | 1030 |

Note 10: Eastman Chemical Co.
Notes 11, 12, 13: Nippon Paint Co., Ltd., synthetic resin master color emulsions To 940 parts of Coating Base No. 1 are added 20 parts each of ethylene glycol, dibutyl phthalate and Texanol, and after thorough mixing, 23 parts of Hi-Vinylex Yellow Brown, 4 parts of Hi-Vinylex Red Rust and 3 parts of Hi-Vinylex Black are added to the mixture to give a coating composition.

EXAMPLE 2

| | |
|---|---|
| Coating Base No. 2 | 940 |
| Diethylene glycol monobutyl ether acetate | 60 |
| International Color Blue (Note 14) | 15 |
| International Color Black (Note 15) | 2 |

-continued

| | |
|---|---|
| Total | 1017 |

Notes 14, 15: International K.K., aqueous master colors

To 940 parts of Coating Base No. 2 is added 60 parts of diethylene glycol monobutyl ether acetate, and after thorough mixing, 15 parts of International Color Blue and 2 parts of International Color Black were added to the mixture to give a coating composition.

EXAMPLE 3

| | |
|---|---|
| Coating Base No. 3 | 940 |
| Diethylene glycol | 60 |
| Tricresyl phosphate | 20 |
| Hi-Vinylex Yellow Brown | 23 |
| Hi-Vinylex Red Rust | 4 |
| Hi-Vinylex Black | 3 |
| Total | 1050 |

To 940 parts of Coating Base No. 3 are added 40 parts of diethylene glycol and 20 parts of tricresyl phosphate, and after thorough mixing, 23 parts of Hi-Vinylex Yellow Brown, 4 parts of Hi-Vinylex Red Rust and 3 parts of Hi-Vinylex Black are added to the mixture to give a coating composition.

EXAMPLE 4

| | |
|---|---|
| Coating Base No. 4 | 938 |
| Ethylene glycol | 20 |
| Diethylene glycol monobutyl ether acetate | 20 |
| Dibutyl phthalate | 20 |
| Hi-Vinylex Lemon Yellow | 30 |
| Hi-Vinylex Blue | 10 |
| Versamide 5201-HR-65 (Note 16) | 17.6 |
| Total | 1055.6 |

Note 16: Henkel Japan, Ltd., a polyamide type curing agent

To 938 parts of Coating Base No. 4 are added 20 parts each of ethylene glycol, diethylene glycol monobutyl ether acetate and dibutyl phthalate, and after thorough mixing, 30 parts of Hi-Vinylex Lemon Yellow and 10 parts of Hi-Vinylex Blue are added as colorants. The above mixture is further mixed well with 17.6 parts of Versamide 5201-HR-65 to provide an amine equivalent-/epoxide equivalent ratio of 1.

CONTROL EXAMPLE 1

| | |
|---|---|
| Coating Base No. 1 | 940 |
| Dipentene | 60 |
| Hi-Vinylex Yellow Brown | 23 |
| Hi-Vinylex Red Rust | 4 |
| Hi-Vinylex Black | 3 |

-continued

| | |
|---|---|
| Total | 1030 |

To 940 parts of Coating Base No. 1 is added 60 parts of dipentene, and after thorough mixing, 23 parts of Hi-Vinylex Yellow Brown, 4 parts of Hi-Vinylex Red Rust and 3 parts of Hi-Vinylex Black are added, followed by thorough mixing.

CONTROL EXAMPLE 2

| | |
|---|---|
| Coating Base No. 1 | 940 |
| Movinyl DM-21 | 300 |
| Ethylene glycol | 20 |
| Dibutyl phthalate | 40 |
| Texanol | 40 |
| Hi-Vinylex Yellow Brown | 23 |
| Hi-Vinylex Red Rust | 4 |
| Hi-Vinylex Black | 3 |
| Total | 1370 |

To 940 parts of Coating Base No. 1 is added 300 parts of Movinyl DM-21 for lowering the pigment volume concentration to a level below critical pigment volume concentration and the mixture is stirred thoroughly. This mixture is further mixed thoroughly with 20 parts of ethylene glycol, 40 parts of dibutyl phthalate and 40 parts of Texanol. Then, 23 parts of Hi-Vinylex Yellow Brown, 4 parts of Hi-Vinylex Red Rust and 3 parts of Hi-Vinylex Black are added as colorants.

CONTROL EXAMPLE 3

A commercial white synthetic resin emulsion coating composition is colored with International Colors.

CONTROL EXAMPLE 4

A commercial white textured synthetic resin emulsion coating composition is colored with International Colors.

CONTROL EXAMPLE 5

A commercial synthetic resin emulsion putty is colored with International Colors.

Each of the coating compositions prepared according to the above working and control examples was coated into a relief pattern finish on a slate board (300×300×5 mm) previously coated with Hi-Vinylex Alkali Sealant, using the Texta-Peti-Roller Rose (Japanese Design Registration No. 539840). The coat was allowed to dry at room temperature for a day, after which its projecting portions were polished with a cloth (Note 17). The results of tests are shown in Table 2.

TABLE 2

| | Example 1 | Example 2 | Example 3 | Example 4 | Control Example 1 | Control Example 2 | Control Example 3 | Control Example 4 | Control Example 5 |
|---|---|---|---|---|---|---|---|---|---|
| Polishability (Note 18) | Good | Good | Good | Good | Poor | Poor | Poor | Poor | Poor |
| Gloss of projections (Note 19) | Good | Good | Good | Good | Poor | Poor | Poor | Poor | Poor |
| Variegated pattern quality | Good | Good | Good | Good | Poor | Poor | Poor | Poor | Poor |

Note 17: Polishing method:

(1) Mechanical polishing with a portable polisher (Type NUP-SR3) fitted with a cottony finishing buff on its buff pad (hard type).

(2) Manual polishing of the projecting portions with a cloth or rubbing them with hands wearing cotton gloves.

Note 18: Polishability: The polishability is rated "good" when a gloss can be easily produced by following the second polishing method (2) with ordinary exertion.

Note 19: The gloss and variegated pattern quality were visually evaluated after polishing by the first polishing method (1), based on the degree of gloss of the projecting portions and the color difference between the projecting and recessed portions, respectively.

EXAMPLE 5

Using a coating gun (Iwata Tosoki K.K.) fitted with a 3.5 mm tip, the variegated pattern coating composition of Example 2 was uniformly sprayed on a slate board (30 cm×30 cm) at the spray pressure of 5 kg/cm$^2$ to produce a crater-like patterned coat. The coat was allowed to dry at room temperature for a day and the projecting portions of the coat were polished. The resulting finish had a deeply dark blue bronze-like variegated pattern with glossy projections and various sizes of crater-like recesses.

It is to be understood that the foregoing are given merely by way of illustration and that many variations may be made therein without departing from the scope of the present invention, which is defined in the claims below.

What is claimed is:

1. A method of producing a variegated coat on a surface comprising the steps of coating the surface with a coat of a synthetic resin emulsion coating composition containing a body pigment and a color pigment in a combined concentration higher than critical pigment volume concentration and further containing a high boiling organic solvent or plasticizer, partially drying the thus-produced coat, and polishing locally areas of the resulting partially dried coat while at least a portion of said solvent or plasticizer is still present in the surface layer of the coat, to thereby produce a color difference between the areas so polished and the areas not polished and develop a variegated-color pattern in the dried coat.

2. A method as claimed in claim 1 wherein said coating composition is applied to the surface in a relief pattern and the projecting portions of the pattern are selectively polished.

3. A method as claimed in claim 1 wherein said resin emulsion contains per 100 weight parts thereof, 1 to 20 weight parts of the high boiling solvent or plasticizer.

4. A method as claimed in claim 3 wherein said solvent or plasticizer has a boiling point of at least 190 degrees C.

5. A method as claimed in claim 3 wherein said pigments have an average particle size less than 4 microns as calculated from the specific surface area thereof.

6. A method as claimed in claim 3 wherein said resin emulsion has a pigment volume concentration of from 60% to 80%.

7. A method as claimed in claim 3 wherein said synthetic resin emulsion is a synthetic latices or an aqueous dispersion of an alkyd resin, an epoxy resin or an acrylic resin.

8. A method as claimed in claim 4 wherein said high boiling solvent or plasticizer is a ester type plasticizer, an epoxide type plasticizer, chlorinated paraffin, camphor, a polyhydric alcohol or a derivative thereof.

9. A method as claimed in claim 1 wherein said coating composition contains, per 100 weight parts thereof, 1 to 20 weight parts of a solvent or plasticizer having a boiling point of at least 190° C., has a pigment volume concentration of from 60% to 80%, and said pigments have an average particle size less than 4 microns as calculated from the specific surface area thereof.

10. A method as claimed in claim 9 wherein said resin emulsion is a synthetic latex or an aqueous dispersion of an alkyd resin, an epoxy resin or an acrylic resin and wherein said high boiling solvent or plasticizer is an ester type plasticizer, an epoxide type plasticizer, chlorinated paraffin, camphor, a polyhydric alcohol or a derivative thereof.

11. A method as claimed in claim 9 wherein said resin emulsion is applied to the surface in a relief pattern and the projecting portions of the pattern are selectively polished.

* * * * *